US007162754B2

(12) United States Patent
Haile, Jr.

(10) Patent No.: US 7,162,754 B2
(45) Date of Patent: Jan. 16, 2007

(54) DEVICE FOR MOISTENING PAPER OR CLOTH

(76) Inventor: Malcolm J. Haile, Jr., 101 Bal Harbour St., Bullard, TX (US) 75757

( * ) Notice: Subject to any disclaimer, the term of this patent is extended or adjusted under 35 U.S.C. 154(b) by 99 days.

(21) Appl. No.: 11/065,491

(22) Filed: Feb. 24, 2005

(65) Prior Publication Data

US 2005/0183194 A1 Aug. 25, 2005

Related U.S. Application Data

(60) Provisional application No. 60/547,505, filed on Feb. 25, 2004.

(51) Int. Cl.
*E03D 9/00* (2006.01)

(52) U.S. Cl. ..... 4/661; 239/282

(58) Field of Classification Search ..... 4/661; 239/282

See application file for complete search history.

(56) References Cited

U.S. PATENT DOCUMENTS 3,083,374 A * 4/1963 Watlington ..... 4/353
3,808,608 A 5/1974 Caplan
3,865,271 A 2/1975 Gold
4,667,846 A 5/1987 Marceau
5,044,556 A * 9/1991 Suzuki ..... 239/135
5,381,568 A * 1/1995 Warkentin ..... 4/661
5,887,759 A 3/1999 Avigbe
5,933,881 A 8/1999 Smith
6,675,405 B1 * 1/2004 Harm ..... 4/661
6,959,890 B1 * 11/2005 Breitinger ..... 242/592

FOREIGN PATENT DOCUMENTS

DE 297 16 687 * 9/1997

* cited by examiner

*Primary Examiner*—Charles E. Phillips
(74) *Attorney, Agent, or Firm*—Ronald B Sefrna

(57) ABSTRACT

A device for moistening paper or cloth, and especially a pad of toilet paper immediately prior to use, includes a mounting base, for mounting on a toilet tank or optionally to an adjacent wall; a lever activated spring loaded valve connected to the mounting base, with a nozzle to emit a fine spray when the valve is activated; a paper support and actuator handle for supporting toilet paper or other material over the nozzle and for actuating the valve; and a drain pan disposed below the valve and nozzle to catch any excess water not absorbed by the paper, with a drain tube to drain excess water to the bowl of the toilet.

20 Claims, 9 Drawing Sheets

DEVICE FOR MOISTENING PAPER OR CLOTH

RELATED APPLICATION DATA

This application claims the benefit of U.S. Provisional Patent Application Ser. No. 60/547,505, titled "Device For Moistening Tissue Or Cloth", filed Feb. 25, 2004.

FIELD OF THE INVENTION

The present invention generally relates to the field of spray devices, and in its preferred embodiments more specifically relates to a device integral with or mounted on a toilet, for spraying a fine mist of water or other liquid onto tissue or a cloth when activated by a user.

BACKGROUND AND OBJECTS OF THE INVENTION

Personal hygiene and comfortable cleansing following use of a toilet facility are important considerations. For many people the most effective means for cleaning themselves, or others in their care such as the elderly or small children, is moistened, but not wet, paper or cloth. Various approaches are known in the prior art for moistening, especially, paper, but all are subject to certain disadvantages and drawbacks. Paper, such as toilet paper, may be moistened by holding the paper under running water from, e.g., a bathroom sink faucet, but this approach results in either spotty application of the water or excessive wetting of the paper and is an unsatisfactory solution.

In another approach, water may be sprayed onto the paper from a hand held spray bottle or from a device mounted on the wall and containing a water reservoir. A hand held spray bottle is often inconvenient to use and store, and requires both hands for operation; one to hold the paper and one to activate the spray. The mounted spray devices typically require a pumping action to activate the spray, and while it may be possible for a user to operate the devices known in the prior art with one hand, it is cumbersome to do so and it is difficult to avoid overspray. In both cases the water reservoir must be refilled when empty. Water held in a reservoir is subject to growth of bacteria and algae, which can be detrimental to the users.

Packaged pre-moistened wipes may be used for cleansing, but such wipes are typically not flushable, and are significantly more costly than conventional toilet paper.

Accordingly, there remains a need for an effective and easy to use device for moistening paper or cloth, and especially toilet paper that does not require refilling of a water reservoir, avoids overspray of the water intended for moistening, may be unobtrusively and conveniently mounted for easy access.

SUMMARY OF THE INVENTION

Accordingly, it is among the objects of the present invention to provide a fresh water supply attached to or near the toilet for the purpose of moistening toilet tissue or wash cloths for sanitary and comfortable cleansing.

It is also among the objects of the present invention to provide a fresh water supply attached or near the toilet for the purpose of providing a fine mist of water for moistening toilet tissue or wash cloths.

It is still further among the objects of the present invention to provide a fresh water supply attached to or near the toilet for moistening toilet tissue or wash cloths that can be easily installed in most existing and newly constructed bathrooms and toilet facilities by non-professionals.

The present invention provides a device that may be conveniently and easily mounted either on a toilet or adjacent to a toilet and connected to an existing water supply line. The device of the invention allows a user to activate the device with one hand to release a controlled amount of water in a fine spray or mist from the water supply onto a selected quantity of toilet paper or the like that is held by the user in the same hand used to activate the device. Any excess water is collected in a drip pan from which the excess water is drained to the toilet bowl.

In the preferred embodiment the device of the invention includes a mounting base, for mounting on a toilet tank or optionally to an adjacent wall; a lever activated spring loaded valve connected to the mounting base, with a nozzle to emit a fine spray when the valve is activated; a paper support and actuator handle for supporting toilet paper or other material over the nozzle and actuating the valve; and a drain pan disposed below the valve and nozzle to catch any excess water not absorbed by the paper, with a drain tube to drain excess water to the bowl of the toilet.

In the preferred embodiment the drain pan is separate from the mounting base and is received in a mounting ring attached to the mounting base. In an alternative embodiment the drain pan is integral with the mounting base. The paper support and actuator handle is preferably formed of a rigid mesh, which serves to support the paper in a preferably slightly cupped configuration over the nozzle while allowing droplets of water emitted from the nozzle to penetrate the mesh to moisten the paper. The paper support and actuator handle are depressed to activate the valve against a spring bias, and the spring closes the valve as soon as the handle is released.

The valve of the device is connected to an existing water utility line, preferably the water line supplying water to the toilet tank, with an easily installed "T" fitting and a length of pressure tubing. Because the water supply to the nozzle, through the valve, is provided directly from the water system a steady supply of clean water is assured. The valve may be readily controlled by a user to regulate the flow to the nozzle and thus the amount of water emitted from the nozzle to the paper, and because the water is supplied to the valve, and through the valve to the nozzle, at line pressure, a fine spray will be emitted from the nozzle at any rate of flow.

The structure and features of the device of the invention will be described in detail below, with reference to the accompanying drawing figures.

DESCRIPTION OF THE INVENTION

Figure 1:
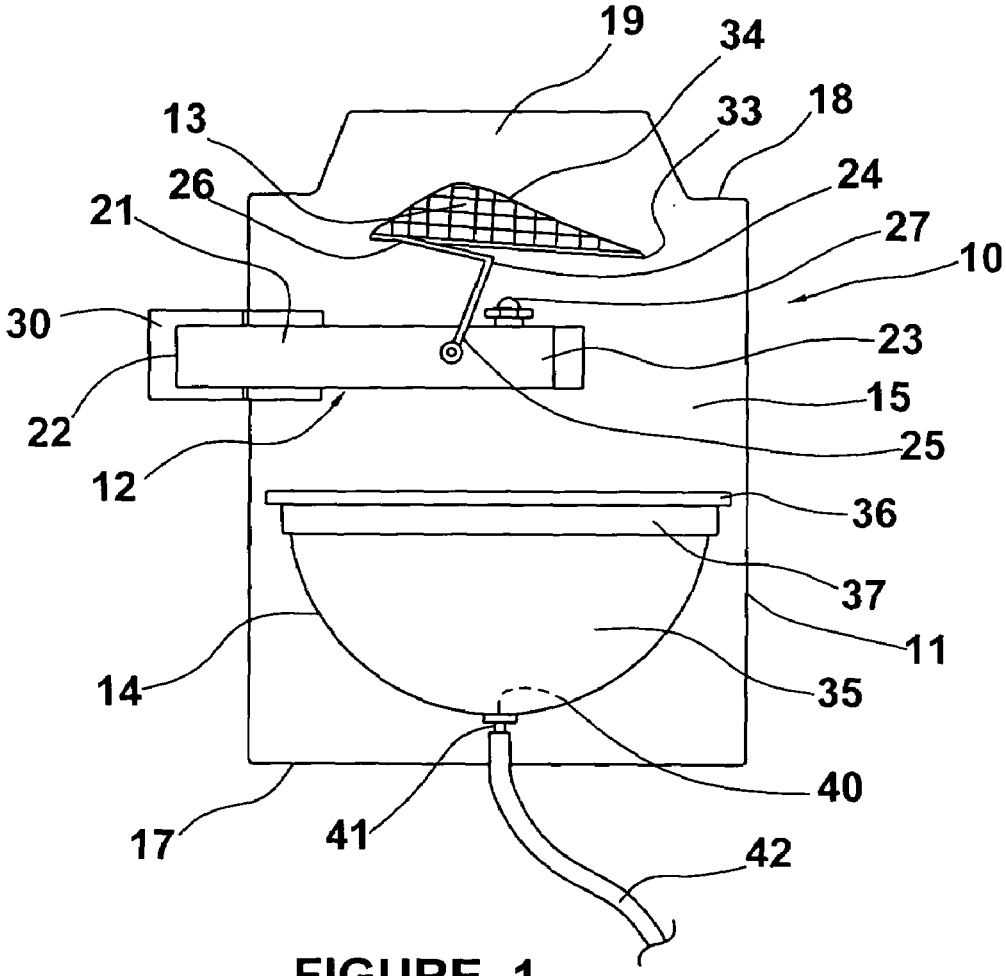
FIG. 1 is a front elevation view of a preferred embodiment of the device of the invention.
Figure 2:
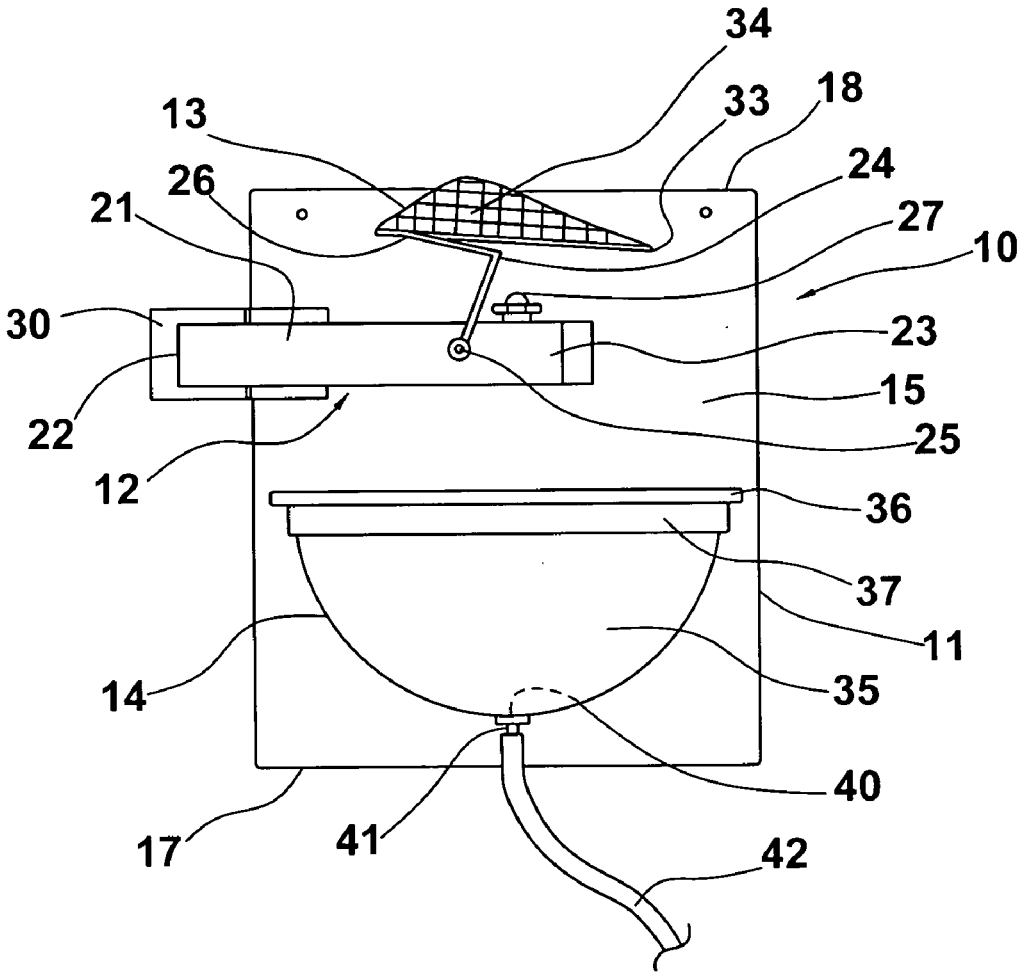
FIG. 2 is a front elevation view of a preferred embodiment of the device of the invention with a removable hanger.
Figure 3:
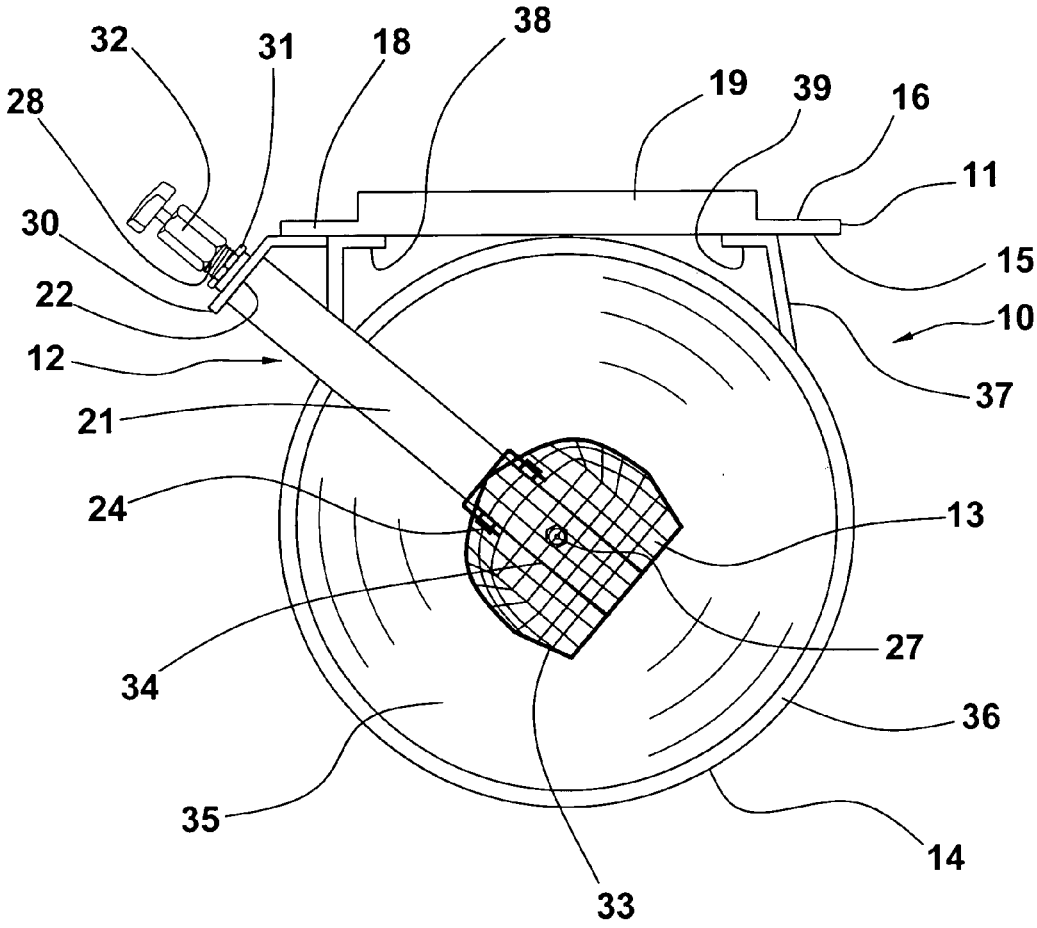
FIG. 3 is a top plan view of a preferred embodiment of the device of the invention.
Figure 4:
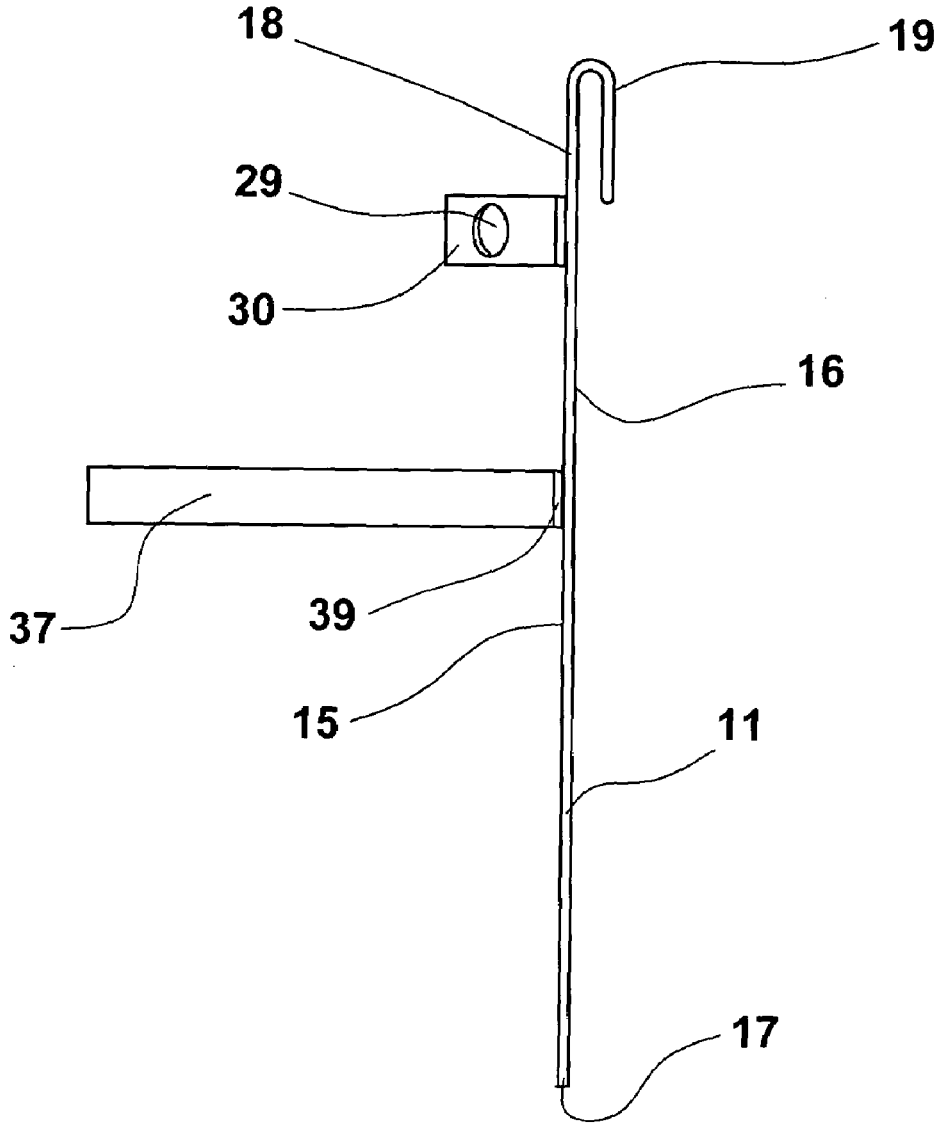
FIG. 4 is a side elevation view of one embodiment of the mounting base and hanger components, with a valve mounting bracket a bowl support band connected thereto.
Figure 5:
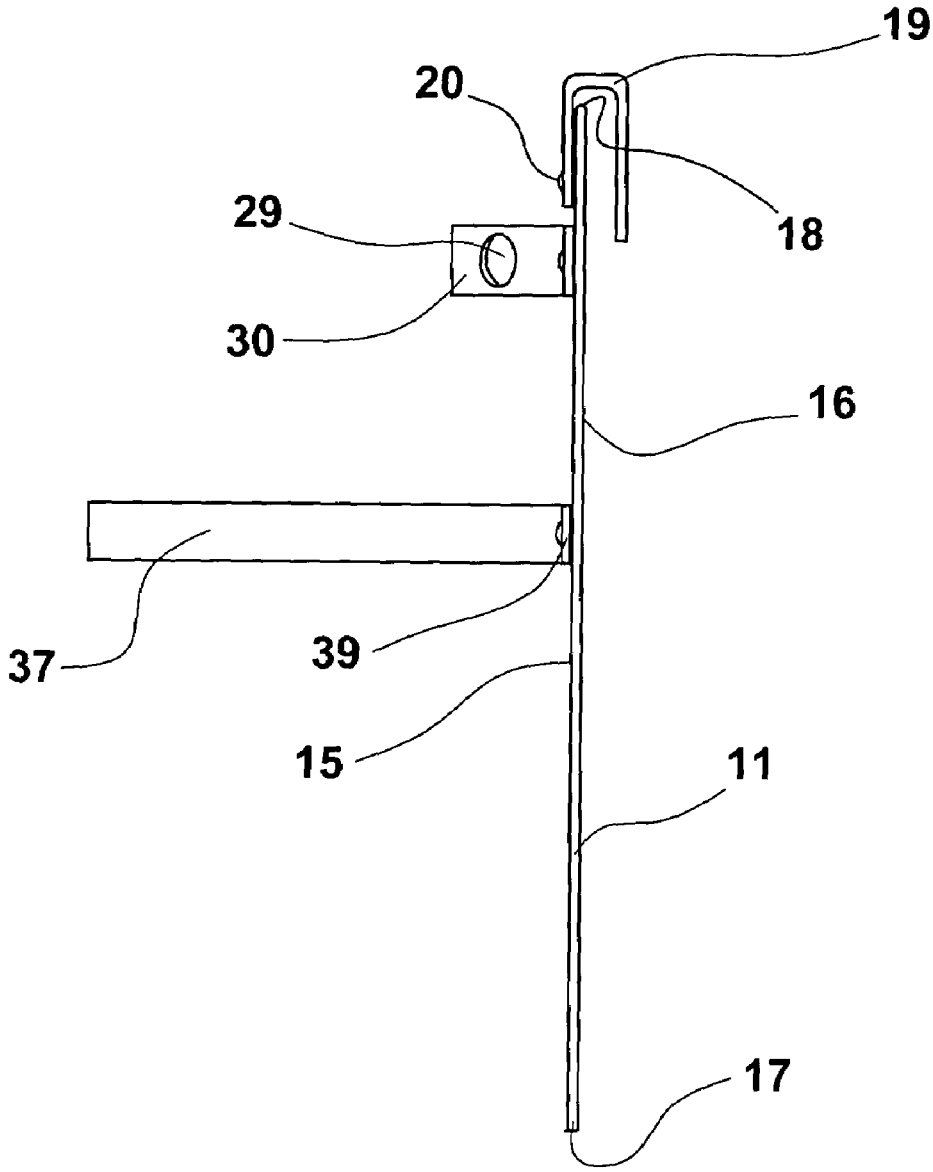
FIG. 5 is a side elevation view of a second embodiment of the mounting base and hanger components, with a valve mounting bracket and a bowl support band connected thereto.
Figure 6:
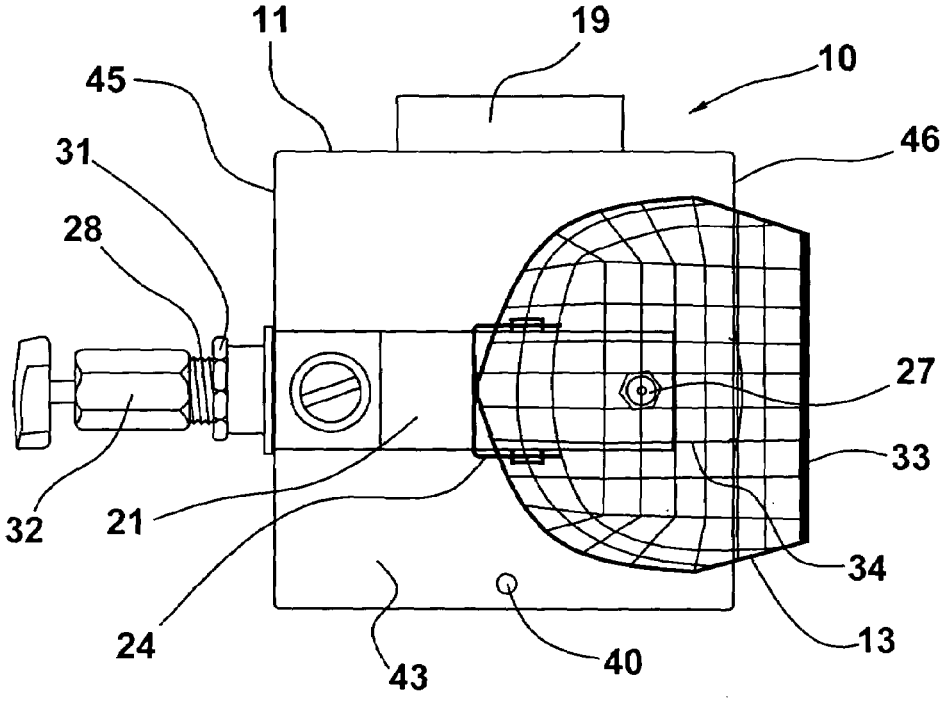
FIG. 6 is a top plan view of an alternative embodiment of the device of the invention.
Figure 7:
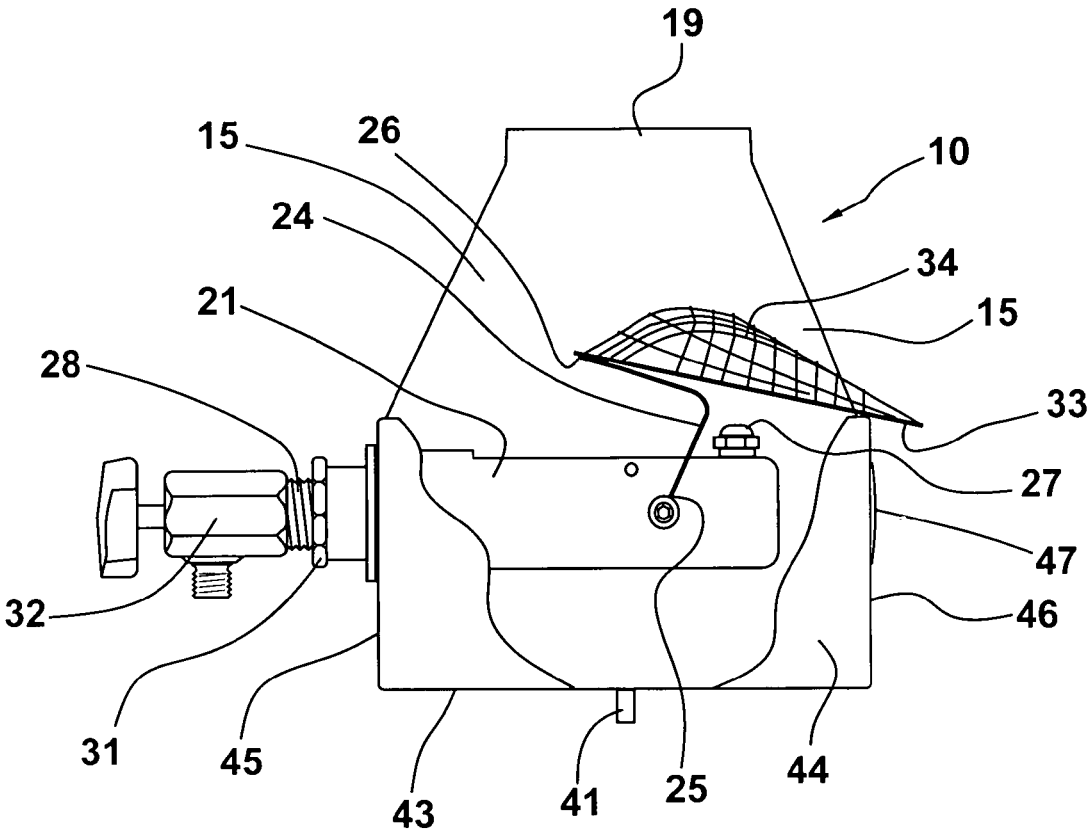
FIG. 7 is a partially cut-away front elevation view of the alternative embodiment of the device of the invention.
Figure 8:
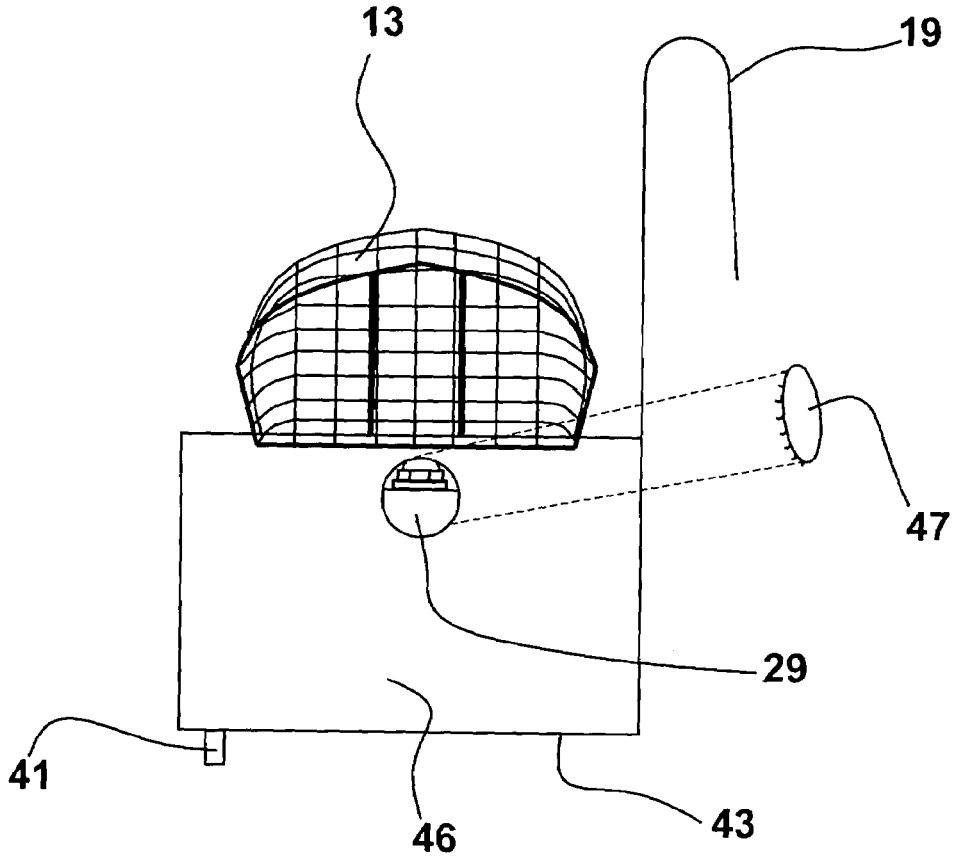
FIG. 8 is a side elevation view of the alternative embodiment of the device of the invention.
Figure 9:
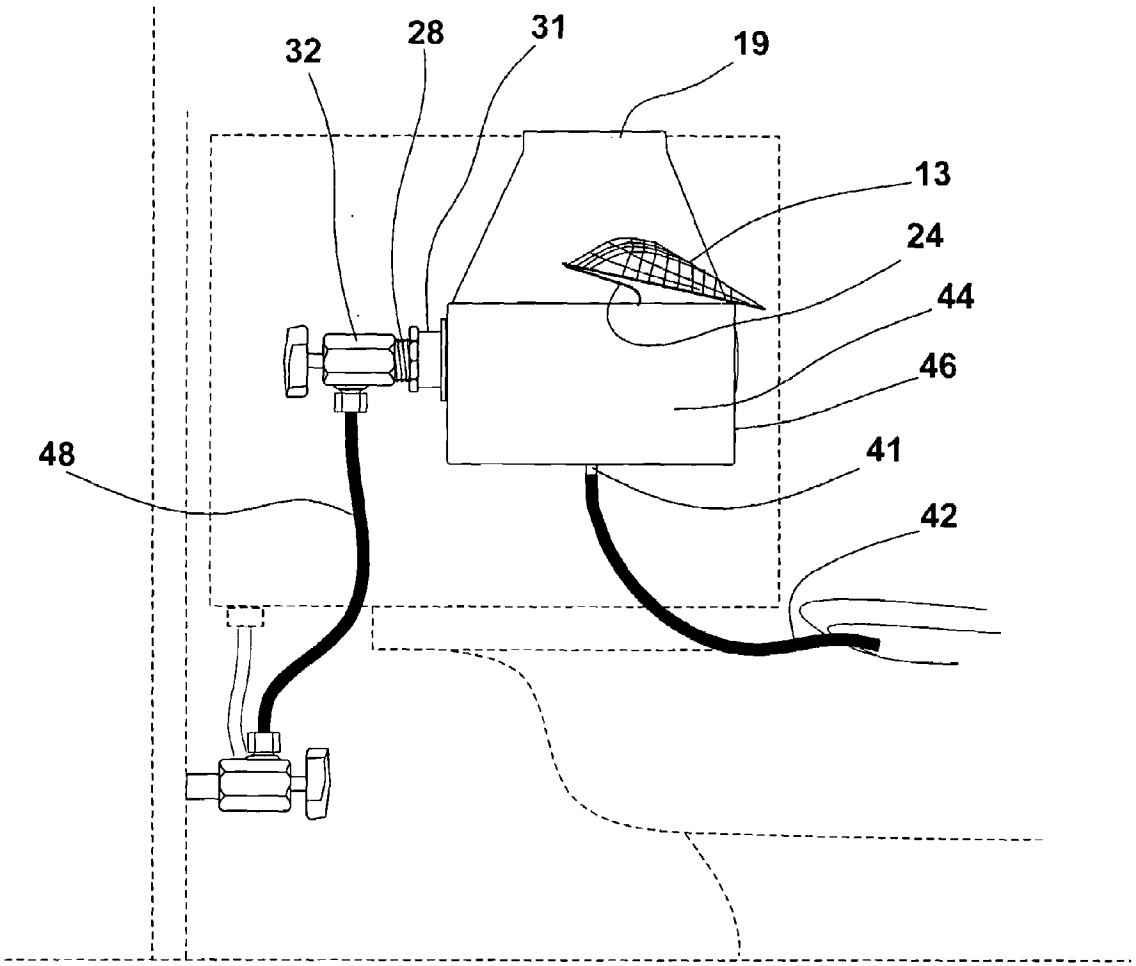
FIG. 9 is an illustration of a device in accordance with the invention, hanging on a toilet tank, and showing connection to a water supply line and drain tube extending to the toilet bowl.

In the preferred embodiment, the device of the invention, generally identified by reference number 10, includes a mounting base 11, a lever actuated spring loaded valve assembly 12, with a paper support and actuator handle 13, and a drip pan 14. Mounting base 11 is formed as a generally flat plate with a front face 15, a rear face 16, a lower edge 17, and an upper edge 18. A generally U-shaped hanger 19 extends upwardly from the upper edge of the mounting base and curves back beyond the rear face of the mounting base for hanging the mounting base over the upper lip of a toilet tank, so that the rear face 16 lies against the outer surface of the toilet tank at one end of the tank. Hanger 19 is formed so as to avoid interference with the placement of the tank lid on the toilet tank.

Hanger 19 may be integrally formed with the mounting base 11 from a single piece of material, or may be separately formed and connected to the mounting base. A separate hanger 19 may be formed in a variety of configurations and structures within the scope of the invention. As non-limiting examples, such a hanger may be formed in the same general configuration as in the integral embodiment and attached to the mounting base with, e.g., screws or bolts 20, or the hanger may be formed from wire or rod and hooked into apertures adjacent to upper edge 18 of the mounting base. With the removable hanger embodiment, mounting base 11 may be easily mounted on a wall by removing hanger 19 and placing the rear face 16 of the mounting base flat against a wall. Screws or other fastening means may be driven through the apertures in the mounting base and into the wall to secure the mounting base.

Valve assembly 12 of the preferred embodiment includes an elongate body 21, with an inlet end 22 and an outlet end 23. A valve seat and a spring loaded or biased valve member (not shown) are housed in valve body 21, with the valve member moved away from the valve seat against the spring bias by lever 24, to allow water to flow through the valve seat and the body of the valve. Lever 24 has a first end 25 and a second end 26, and is pivotally connected to valve body 21 with the first end operatively connected to the valve member and the second end extending upwardly from the valve body at an angle. Depression of the first end of lever 24 toward the valve body moves the valve body away from the seat and allows water to flow through the seat. In the preferred embodiment, lever 24 is bifurcated, with parallel legs extending from either side of the valve body, but any configuration that allows the interconnections and functions described below may be used. More generally, it should be understood that the scope of the invention is not limited to the specific valve assembly configuration illustrated in the drawing figures, and that other configurations may be utilized if desired, as long as means of activation and the functions of the device of the invention are accomplished. For example, the spring for biasing the valve member in a closed position relative to the valve seat may be operatively connected directly to lever 24, to apply the spring force to the lever to maintain the valve member against the valve seat, rather than acting directly upon the valve member.

A spray nozzle 27 is connected to valve body 21 in the outlet end of the valve body, downstream of the valve seat and valve member, positioned so that the nozzle will direct a flow of water in an upward direction when the device of the invention is mounted for use. When lever 24 is depressed to operate the valve, the outlet for the water from the valve body is through nozzle 27, which is selected to emit a fine spray or mist of liquid through the nozzle outlet in a controlled dispersion pattern.

Inlet end 22 of the valve body includes a threaded inlet nipple 28 that extends through a valve mounting aperture 29 in a valve mounting bracket 30 through which the valve is connected to the mounting base of the device. In the preferred embodiment bracket 30 is formed as an angled or generally V-shaped plate with one of the legs of the V connected to mounting base 11 at one of the edges in parallel relation to the mounting base, and with the other leg of the V extending outward from the edge of the mounting base at an angle. The mounting bracket may be connected to either edge of the mounting base, so that the device may be placed at either end of a on a toilet tank or on a wall on either side of the toilet. A nut assembly 31 is threaded onto the inlet nipple 28 and against bracket 30 to securely connect the valve body to the bracket. The angle of the bracket is such that valve body 21 extends outwardly and across the outer face of the mounting base. It is preferred that an inlet valve 32 be connected to the outer end of inlet nipple 28, so that the water supply to the valve can be controlled at that location. However, if desired, valve 32 may be omitted and a supply line be connected directly to inlet nipple 28 or connected through, e.g., an elbow fitting.

In the preferred embodiment of the invention, paper support and actuator handle 13 is formed in a shallow cup-like configuration, with a perimeter 33 and a perforate central portion 34. It is preferred that the perimeter be formed of a stainless steel wire or rod, and the central portion of stainless steel mesh, both with sufficient rigidity to maintain their shape and resist any bending or other deformation during use of the device. Other materials of construction and other configurations may be used, but it is important that the central portion of the paper support and actuator handle 13 be substantially open to allow the flow of a mist of liquid through the handle with minimal obstruction. For example, a plurality of thin, spaced apart rods may be used to form the central portion of the paper support and actuator handle. Handle 13 is disposed at and connected to the second, outer, end 26 of lever 24 so that the handle will be generally centered over nozzle 27 when lever 24 is depressed to activate water flow through the valve body and emission of a mist of water from the nozzle, so that the mist is directed through the open mesh or perforations of the handle within the perimeter of the handle.

Drip pan 14 is preferably formed as a shallow bowl 35 with a lip 36 extending outwardly from the upper edge of the bowl. The drip pan is removably suspended on mounting base 11 by bowl support band 37, which is formed in a curved configuration and connected at its first end 38 and its second end 39 to mounting base 11. Band 37 is configured and dimensioned so that the bowl of the drip pan is received through the band and lip 36 rests on the upper edge of the band to support the drip pan against the outer face of the mounting base below valve body 21. Bowl 35 is penetrated by a drain aperture 40 at the bottom of the bowl, and a drain nipple 41 is connected to the bowl around the drain aperture, for connection of a drain tube 42.

In an alternative embodiment, removable bowl 35 and band 37 are omitted, and drain pan 14 is formed as an integral construction with mounting base 11. In this alternative the drip pan is formed as a hollow open topped box with a bottom 43, a front wall 44, and side walls 45 and 46. The bottom and side walls are connected to the outer face of the mounting base to form an open topped hollow receptacle on mounting base 11 below valve body 21. Although the drain pan of this alternative embodiment is described and illustrated as rectangular, it is to be understood that other configurations could be used within the scope of the invention, such as a curved "half basin" configuration.

In this alternative embodiment valve assembly 12 may be mounted directly to the drain pan, rather than on the mounting base using bracket 30. In the alternative embodiment both side walls are penetrated by valve apertures 29, to allow the valve assembly 12 to be installed through either side wall, as appropriate for the particular installation, and the unused aperture may be closed by a removable plug 47. The bottom of the drain pan is provided with drain aperture 40, drain nipple 41, and drain tube 42.

To use the device of the invention to moisten toilet paper or a cloth, the paper or cloth is folded to the approximate width and length of the handle, and placed on the top of the handle, with the user's hand holding it in place. The user may then depress the handle with the hand holding the tissue cloth in place, to actuate the valve and cause a fine spray or mist of water to be directed from the nozzle against the lower surface of the paper or cloth to moisten it. When the desired quantity of liquid has been sprayed or misted onto the tissue or cloth, the user releases the handle to stop the flow of liquid. The user may then remove the moistened paper or cloth for use. Any excess liquid that has not been absorbed by the tissue or cloth is received within the drain pan, and will drain from the pan through the drain aperture and drain tube. The support provided by handle 13 for the paper or cloth greatly facilitates both the moistening of the material and the removal of the material for use. Toilet paper, especially, can become very fragile when moistened, and supporting the paper while it is moistened and readied for use is a significant improvement.

The illustrated device of the invention may be easily mounted on an existing toilet and prepared for use, and connection of the water supply and drain lines does not require significant plumbing expertise. For mounting the device on a toilet, the toilet tank lid is removed and the device hung on the upper edge of the tank, with hanger 19 extending over the upper edge and into the interior of the tank, and rear face 16 of the mounting base against the outer surface of the tank. A water supply tube 48 is connected between the water line supplying water to the toilet, and valve assembly 12, using a "T" fitting or other appropriate fitting so that both the device of the invention and the toilet will receive water as needed from the main water line. Drain tube 42 is connected to drain nipple 41 and routed unobtrusively down alongside the toilet tank and into the rear of the toilet bowl, so that excess water will automatically drain from the drip pan 14 into the toilet bowl. It is contemplated that the device of the invention may be provided in kit form, with fittings and tubing provided to simplify installation. The valve assembly 12 may be connected to either side of the device, so that the device may be mounted on either side of toilet tank for most convenient placement and use.

Alternatively, the device of the invention may be mounted on a wall adjacent to a toilet. To mount an embodiment of the device in which hanger 19 is removable from the mounting base 11, the hanger may be removed and the mounting base connected to a wall by screws or other suitable fastening means with the rear face of the mounting base flush against the wall. For mounting an embodiment in which hanger 19 is integral with mounting base 11, or in the event that a user does not wish to remove a removable hanger, a simple mounting bracket may be attached to the wall and hanger 19 inserted over the mounting bracket in essentially the same manner as the device is hung on a toilet tank. With a wall mounted placement, drain tube 42 could be used to drain excess water into the toilet bowl, as described above, or excess water could be collected in, e.g., a removable receptacle that could be easily emptied and replaced under the drain pan.

Although the foregoing description and illustrations are based on the concept of a device for use with an existing conventional toilet, it is contemplated that the components of the device of the invention may be incorporated into the structure of a toilet bowl during manufacture. In such an embodiment a toilet tank may be fabricated with a drain section, an aperture for mounting the valve assembly, and a drain provision that will drain excess water into the toilet tank rather than into the toilet bowl.

The foregoing description of preferred and alternative embodiments of the device of the invention is intended to be illustrative and not limiting of the scope of the invention. The device of the invention is susceptible to other alternative embodiments and variations, which may be devised by those of reasonable skill in the art upon the basis of this disclosure and teaching.

The invention claimed is:

1. A device for moistening paper or cloth, comprising a substantially planar mounting base having a front face and a rear face;

a valve assembly having a valve body with a first end and a second end and an interior forming an openable and closable passageway for the flow of liquid through said interior, a fitting at said first end for connecting said interior of said valve body to a source of liquid, a spray nozzle disposed in said valve body adjacent to said second end for emitting a spray of liquid from said interior of said valve body through said spray nozzle when said passageway is open, and an actuator lever, with a first end and a second end, pivotally connected to said valve body with said second end of said actuator lever disposed outwardly therefrom, said actuator lever for opening said passageway when said second end of said lever is depressed toward said valve body about said pivotal connection and closing said passageway when said second end of said lever is moved away from said valve body, said valve assembly interconnected to said mounting base with said second end and said spray nozzle disposed outward of said front face of said mounting base; and a paper support and actuator handle having a perimeter and a central portion with an upper face and a lower face, said central portion disposed within said perimeter for supporting one or more layers of paper or cloth on said upper face of said central portion, said central portion being substantially open to the passage of a spray of liquid therethrough, said handle connected to said second end of said actuator lever of said valve assembly, with said actuator lever and said handle disposed relative to said valve body such that said lower face of said central portion of said handle is positioned over said spray nozzle to receive liquid sprayed therefrom when said handle and said second end of said actuator lever are depressed toward said valve body to open said passageway.

2. The device of claim 1, further comprising a drip pan disposed on said mounting base below said valve assembly to receive excess liquid emitted from said spray nozzle of said valve assembly.

3. The device of claim 2, further comprising a drip pan mounting band connected to said mounting base, wherein said drip pan is formed as a concave bowl with an upper edge and a lip extending outwardly from said upper edge, and wherein said drip pan is suspended relative to said mounting base with said lip of said drip pan received against said mounting band.

4. The device of claim 2, wherein said drip pan includes a drain aperture for draining said excess liquid from said drip pan.

5. The device of claim 2, wherein said drip pan comprises a hollow open top box having opposing side walls connected to and extending outwardly from said front face of said mounting base, a front wall connected between said front walls, and a bottom connected between said sidewalls, said front wall, and said front face of said mounting base.

6. The device of claim 1, wherein said valve assembly further includes a biasing means for biasing said actuator lever toward a position for the closing of said liquid passageway.

7. The device of claim 1, wherein said mounting base has an upper edge and wherein said mounting base further includes a hanger extending from said mounting base so as to be received over the upper edge of a toilet tank for suspending said mounting base on the exterior of said toilet tank.

8. The device of claim 1, wherein said mounting base is mountable on a wall with said rear face of said mounting base received against the wall.

9. The device of claim 1, wherein said valve assembly further includes a liquid control valve connected to said fitting at said first end of said valve body.

10. The device of claim 1, wherein said source of liquid is a potable water supply system.

11. The device of claim 4, wherein said liquid is water, said source of liquid is a water line supplying clean water to a toilet, wherein said device further comprises an inlet tube for carrying water between said water line and said fitting of said valve assembly, and a drain tube for carrying excess water from said drip pan to a receptacle for said excess water.

12. The device of claim 11, wherein said receptacle for said excess water is the bowl of said toilet.

13. The device of claim 1, wherein said central portion of said paper support and actuator handle is formed of a rigid mesh.

14. The device of claim 13, wherein said mesh is formed of metal wire.

15. The device of claim 1, wherein said mounting base is integrally formed as a part of the tank of a flush toilet.

16. A device for moistening toilet paper with a spray of water, to be positioned adjacent to a flush toilet having a bowl and a water supply line for supplying clean water to the toilet, comprising a substantially planar mounting base having a front face and a rear face, and an upper end and a lower end, for mounting said device adjacent to said toilet;

a valve assembly having a valve body with a first end and a second end and an interior forming an openable and closable passageway for the flow of water through said interior, a water inlet fitting at said first end for connecting said interior of said valve body to said water supply line, a spray nozzle disposed in said valve body adjacent to said second end for emitting a spray of water from said interior of said valve body through said spray nozzle when said passageway is open, and an actuator lever, with a first end and a second end, pivotally connected to said valve body with said second end of said actuator lever disposed outwardly therefrom, said actuator lever for opening said passageway when said second end of said lever is depressed toward said valve body about said pivotal connection and closing said passageway when said second end of said lever is moved away from said valve body, said valve assembly interconnected to said mounting base with said second end and said spray nozzle disposed outward of said front face of said mounting base;

a paper support and actuator handle having a perimeter and a central portion with an upper face and a lower face, said central portion disposed within said perimeter for supporting one or more layers of toilet paper on said upper face of said central portion, said central portion being substantially open to the passage of a spray of liquid therethrough from said spray nozzle of said valve assembly to toilet paper supported on said upper face, said handle connected to said second end of said actuator lever of said valve assembly, with said actuator lever and said handle disposed relative to said valve body such that said lower face of said central portion of said handle is positioned over said spray nozzle when said handle and said second end of said actuator lever are depressed toward said valve body to open said passageway;

a drip pan disposed on said mounting base between said valve assembly and said lower end of said mounting base to receive drips of water emitted from said spray nozzle, said drip pan including an aperture for draining water therefrom and a hollow drain nipple connected to said drip pan around said aperture and extending outwardly therefrom;

a water inlet tube for conveying water between said water supply line and said fitting of said valve body; and a drain tube for conveying water from said drip pan through said aperture and said drain nipple to a receptacle for said water.

17. The device of claim 16, wherein said valve assembly includes an inlet control valve connected between said valve body and said water inlet fitting.

18. The device of claim 16, wherein said water inlet tube has a first end and a second end, wherein said first end is connected to said water inlet fitting of said valve assembly, and wherein said water inlet tube includes a T-fitting at said second end thereof for connection of said water inlet tube to said water supply line to supply water to said valve assembly without interfering with the supply of water to said toilet.

19. The device of claim 16, wherein said valve assembly further includes a biasing means for biasing said actuator lever toward the closing of said passageway.

20. The device of claim 16, wherein said central portion of said paper support and actuator handle is formed of a rigid mesh.

* * * * *